US007779521B2

(12) United States Patent
Topolkaraev et al.

(10) Patent No.: US 7,779,521 B2
(45) Date of Patent: Aug. 24, 2010

(54) HYDROENTANGLED NONWOVEN FABRICS, PROCESS, PRODUCTS AND APPARATUS

(75) Inventors: Vasily Aramovich Topolkaraev, Appleton, WI (US); John Herbert Conrad, Alpharaetta, GA (US); Jared Lockwood Martin, Cumming, GA (US); Stephen Avedis Baratian, Roswell, GA (US); Jayant Chakravarty, Woodbury, MN (US); Richard Warren Tanzer, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 914 days.

(21) Appl. No.: 11/644,604

(22) Filed: Dec. 22, 2006 (Under 37 CFR 1.47)

(65) Prior Publication Data

US 2008/0150185 A1 Jun. 26, 2008

(51) Int. Cl.
*D04H 1/46* (2006.01)

(52) U.S. Cl. ..... 28/104; 28/167

(58) Field of Classification Search ..... 28/104, 28/105, 167, 165; 264/109, 211.14; 156/148
See application file for complete search history.

(56) References Cited

U.S. PATENT DOCUMENTS

| | | | | |
|---|---|---|---|---|
| 2,981,999 | A * | 5/1961 | Russell | 65/479 |
| 3,485,706 | A | 12/1969 | Evans | |
| 3,873,255 | A * | 3/1975 | Kalwaites | 28/104 |
| 4,704,116 | A | 11/1987 | Enloe | |
| 4,783,231 | A | 11/1988 | Raley | |
| 4,788,756 | A | 12/1988 | Leitner, Sr. | |
| 5,060,105 | A * | 10/1991 | Howey | 360/133 |
| 5,486,166 | A | 1/1996 | Bishop et al. | |
| 5,490,846 | A | 2/1996 | Ellis et al. | |
| 5,814,178 | A * | 9/1998 | Jacobs | 156/290 |
| 6,149,934 | A | 11/2000 | Krzysik et al. | |
| 6,375,889 | B1 * | 4/2002 | Holmes et al. | 264/518 |
| 6,663,611 | B2 | 12/2003 | Blaney et al. | |
| 6,673,158 | B1 * | 1/2004 | Ouellette et al. | 134/6 |
| 6,893,522 | B1 * | 5/2005 | Crainic | 156/148 |
| 7,128,789 | B2 * | 10/2006 | Ouellette et al. | 134/6 |
| 2003/0082360 | A1 | 5/2003 | O'Donnell et al. | |
| 2004/0137211 | A1 * | 7/2004 | Ouellette et al. | 428/317.9 |
| 2004/0147189 | A1 * | 7/2004 | Smith et al. | 442/121 |
| 2006/0273495 | A1 | 12/2006 | Topolkaraev et al. | |
| 2006/0276092 | A1 | 12/2006 | Topolkaraev et al. | |

FOREIGN PATENT DOCUMENTS

EP 1 226 296 B1 5/2003

OTHER PUBLICATIONS

American Society for Testing Materials (ASTM) Designation: E1640-04, "Standard Test Method for Assignment of the Glass Transition Temperature By Dynamic Mechanical Analysis," pp. 1-5, published Jul. 2004.

* cited by examiner

*Primary Examiner*—Amy B Vanatta
(74) *Attorney, Agent, or Firm*—Alyssa A. Dudkowski

(57) ABSTRACT

Fibers are hydroentangled at temperatures near or above their glass transition temperature, the resultant fabrics are then rapidly cooled. A process of preparing a nonwoven fabric that includes depositing fibers on a foraminous support; impinging hot or warm water upon the fibers to hydroentangle them; and then rapidly cooling the resultant fabric is disclosed. The hydroentangled fabric resulting from this process, products made from the hydroentangle fabric, and the equipment used to prepare the fabrics are described.

19 Claims, 2 Drawing Sheets

HYDROENTANGLED NONWOVEN FABRICS, PROCESS, PRODUCTS AND APPARATUS

BACKGROUND

Nonwoven fabrics may be produced by hydroentangling webs of fibers with high energy water jets as described in U.S. Pat. No. 3,485,706 (Evans et al). Hydroentangled nonwovens have been used for disposable rags, outer cover and liner materials for absorbent products, as substrates for wet wipes, and for various other single-use disposable, and multiple-use applications.

Various fiber types have been successfully hydroentangled. Short fibers, such as wood pulp, recycled fibers, and cotton linters have been hydroentangled, sometimes with the aide of a scrim or long fiber matrix. Longer, staple length fibers are also known to be amenable to the hydroentangling process, including polyesters, cotton staple, polyamides, polyacrylates, and polyolefins. Among the polyesters, polyethylene terephthalate, aliphatic-aromatic co-polyesters, polyhydroxyalkanoates (PHA), and polylactide (PLA or polylactic acid) have been hydroentangled. Fabrics comprising continuous filaments, such as spunbond nonwoven fabrics, are also known to be suitable for hydroentangling.

EP 1 226 296 B1 (Fingal et al) discusses heating polymer fibers at the moment of hydroentangling to reduce the flexural rigidity of the fibers and achieve a higher degree of entanglement in the finished fabric. Fingal et al; reported that the increased entanglement was reflected in greater tensile strength when the fabric was tested in surfactant solution.

Hydroentangled nonwoven fabrics are often chosen because of their lower cost, relative to knitted or woven fabrics. To reduce the cost of manufacturing hydroentangled nonwoven fabrics it is desirable to operate the production line at high speed.

One difficulty in hydroentangling certain synthetic fibers is their high wet stiffness, i.e. modulus, compared to wet cellulosic fibers. The stiffness of some synthetics may result in inefficient fiber entanglement, resulting in poor tensile properties of the finished fabrics.

While operating a nonwoven fabric production line at high speed, one aspect is that the fabric is likely to be subjected to high tension as it is transported along the production line. There is a tendency for nonwoven fabrics to "neck" when pulled. This problem is especially severe for soft polymers that are subject to distortion under tension. Necking is the tendency for the fabric to stretch in the direction of tension (usually the machine direction or MD), while contracting in the perpendicular direction (cross machine direction or CD). Furthermore, the fabrics tend to distort non-uniformly, becoming more stretched along the median than along either edge. Such a distorted sheet of fabric is difficult handle, form into neat rolls and subsequently convert into finished products.

Various solutions to the problem of necking fabrics problem have been attempted. One solution is to use tenter frames, as discussed in U.S. Pat. No. 4,788,756 (Leitner). A tenter frame applies tension to the fabric in the CD, thus limiting necking. Tenter frames have limited utility in high speed operations and tend to be mechanically complex, subject to break down, and cause damage to the selvage.

A second approach to limit necking is to transport fabrics under a minimum of tension. To minimize tension on the fabric, it is transported on screens, drums, or belts and the equipment is gradually and evenly accelerated each time the production line starts up. This approach is widely used in manufacturing, but there inevitably are sections in the production line where the fabric is unsupported; and even with sensors and computer controls, a gradual, even acceleration is difficult to accomplish.

In view of the above, a need currently exists for a high speed, inexpensive, reliable method of processing stiff fibers into hydroentangled nonwoven fabrics and minimizing necking. The fabrics made by this process may be used for components of absorbent disposable products, wipers, and other applications.

SUMMARY OF THE INVENTION

The inventors have determined that nonwoven fabrics of superior strength and with reduced necking can be produced by hydroentangling fibers at temperatures near their glass transition temperature and then rapidly cooling the resultant fabrics. A process of preparing a nonwoven fabric that includes depositing fibers on a foraminous support; impinging hot or warm water upon the fibers to hydroentangle them; and then rapidly cooling the resultant fabric is disclosed. The hydroentangled fabric resulting from this process, products made from the hydroentangle fabric, and the equipment used to prepare the fabrics are described.

In one aspect, the present invention relates to a process for preparing a nonwoven fabric. The process includes a step of depositing fibers on a foraminous support and a step of impinging water upon the fibers. Next, the process includes a step of entangling the fibers to form a coherent fabric. The coherent fabric is then cooled very rapidly, desirably within one second after the fabric is formed by entanglement of the fibers. Desirably, at least 25% of the fibers used to form the coherent fabric have a glass transition temperature ($T_g$) in the range of 50° C. (Celsius) to 100° C. and an average $T_g$ of $T(50\text{-}100)_g$. Further, it is desirable for the water used for impinging to have a temperature in the range from 15° C. below $T(50\text{-}100)_g$ to 99° C. In another aspect of the process of the invention, at least 50% of the fibers used to form the coherent fabric have a $T_g$ in the range of 50° C. to 99° C. It is also possible for 75% of the fibers to have a $T_g$ in the range of 50° C. to 99° C.

In another aspect, the present invention relates to a process of preparing a nonwoven fabric including the steps of depositing fibers on a foraminous support, impinging water upon those fibers and entangling the fibers to form a coherent fabric. The process may also include a step of cooling the coherent fabric rapidly after the hydroentangling step. For example, the fabric may be cooled within one second of hydroentangling. Desirably, at least 25% of the fibers have a glass transition temperature ($T_g$) in the range of 50° C. (Celsius) to 100° C. The fibers having a $T_g$ in the range of 50° C. to 100° C. desirably have a softening ratio, SR(75/25), in the range of 2 to 1000. Alternatively, the fibers having a $T_g$ in the range of 50° C. to 100° C. may have a softening ratio, SR(75/25), in the range of 10 to 300.

In another aspect, the present invention relates to an apparatus to form hydroentangled fabrics. The apparatus includes at least one hot water jet or curtain capable of hydroentangling fibers. Desirably, the hot water emitted from the hot water jet or hot water curtain has a temperature between 50° C. and 99° C. (Celsius). The apparatus further includes at least one cold water jet or cold water curtain to cool the hydroentangled fabric. Desirably, the cold water emitted from the cold water jet or cold water curtain has a temperature between 0° C. and 25° C. (Celsius). The apparatus is desirably configured in such a way that the after exiting the hot water jet (or hot water curtain), the hydroentangled fabric travels less than a meter before contacting the cold water jet (or cold water curtain).

These aspects and additional aspects of the invention will be described in greater detail herein. Further, it is to be understood that both the foregoing general description and the following detailed description are exemplary and are intended to provide further explanation of the invention claimed. The accompanying drawings, that are incorporated in and constitute part of this specification, are included to illustrate and provide a further understanding of the processes and apparatus of the invention. Together with the description, the drawings serve to explain various aspects of the invention.

DETAILED DESCRIPTION OF THE INVENTION

Figure 1:
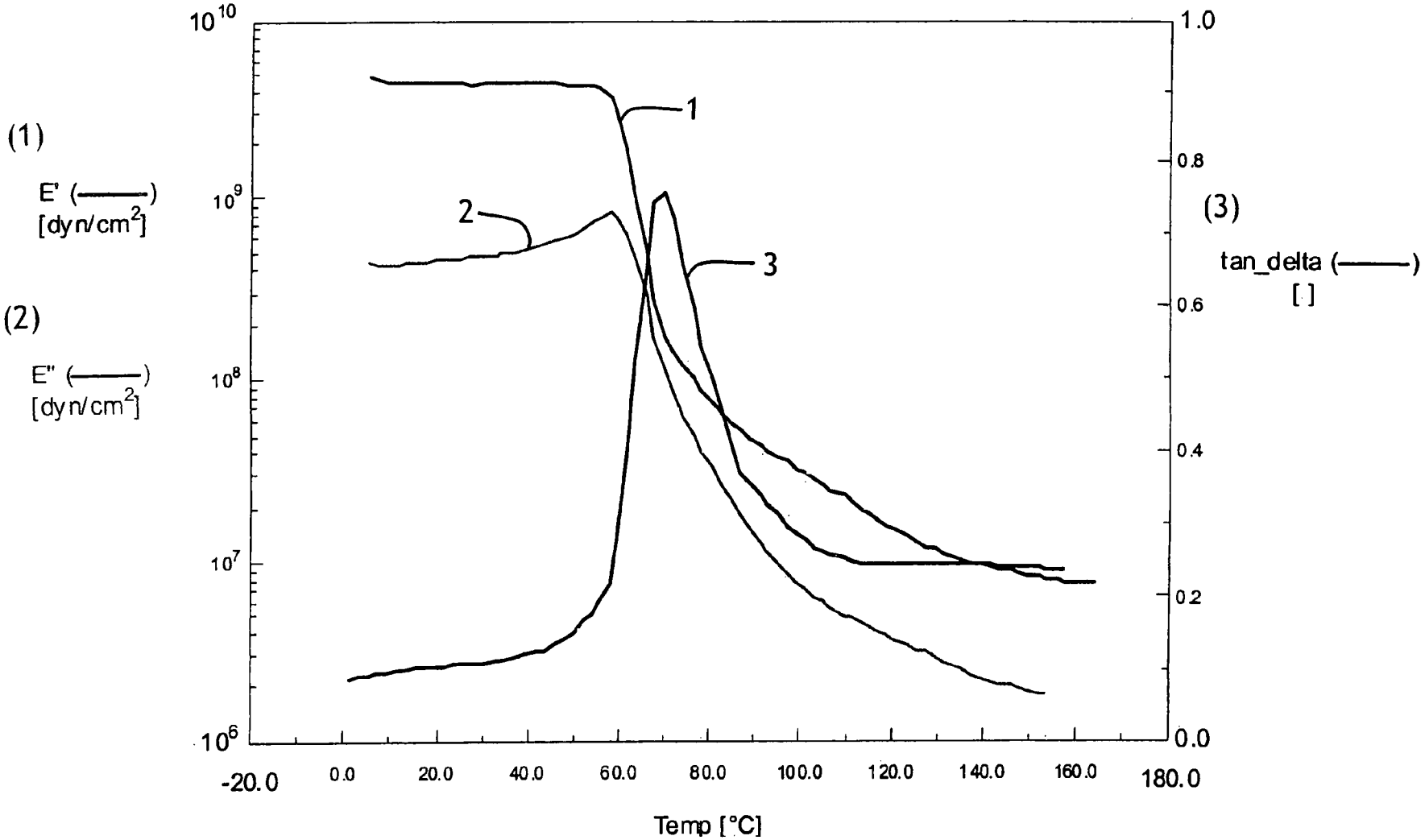
FIG. 1 is a plot of storage modulus (E') and loss modulus (E") for a particular PLA fiber sample. The tangent(delta) or tan(δ), equal to E"/E' is also shown on the plot.

The inventors have determined that nonwoven fabrics of superior strength and with reduced necking can be produced by hydroentangling fibers at temperatures near their glass transition temperature and then rapidly cooling the resultant fabrics.

Hydroentangling is a commercially important bonding method for making soft, drapable nonwoven fabrics. These fabrics are used as wet and dry wipers, and as liners and outer cover materials in absorbent articles such as bandages, diapers, incontinence devices and sanitary napkins.

The general principles and practices of hydroentangling are well known in the nonwovens industry, and will not be discussed in detail here. Hydroentangling equipment is commercially available from Rieter Perfojet (a division of Rieter Holding, Ltd. with offices in Winterthur, Switzerland), Fleissner GmbH (with offices in Egelsbach, Germany) and elsewhere.

Preparing fabrics of some embodiments of the invention includes a preliminary step of providing a more-or-less uniform layer of fibers. This may be achieved by carding, air laying, or wet laying fibers and other means. Alternatively or additionally, the layer of fibers may consist of a preformed nonwoven fabric, prepared by meltblown, spunbond or carding and bonding, as examples. In some embodiments of the invention the layer of fibers may be completely unbonded, in other embodiments of the invention the layer of fibers may be lightly bonded. Lightly bonding the layer of fibers may facilitate transport and reduce the loss of loose fibers.

Fibers may range in length from short wood pulp or cotton linter fibers (in the range of about 0.1 cm to 0.6 cm) to staple or cotton fibers (in the range of about 0.5 cm to 5 cm) to meltblown fibers which are highly variable in length, to continuous fibers, such as rayon tow or fibers produced in the spunbond process.

Various fiber types may be suitable for this invention. Short fibers, such as wood pulp, recycled fibers, and cotton linters have been hydroentangled, sometimes with the aide of a scrim or long fiber matrix; longer, staple length fibers are also known to be amenable to the hydroentangling process, and continuous filaments, such as spunbond fibers may also be used advantageously.

Fibers comprised of a variety of polymer types may be useful in various embodiments of the present invention, such as fibers made with polypropylene, acrylic, nylon, and polyesters. Among the polyesters, polyethylene terephthalate, aliphatic-aromatic copolyesters, polyhydroxyalkanoates (PHA), PLA homopolymer, and PLA copolymer may be satisfactorily used. Other suitable polymers may include polyesteramides, modified polyethylene terephthalate, polylactic acid (PLA), terpolymers based on polylactic acid, polyglycolic acid, polyalkylene carbonates (such as polyethylene carbonate).

The term "polylactic acid" generally refers to homopolymers of lactic acid, or lactide such as poly(L-lactic acid); poly(D-lactic acid); and poly(DL-lactic acid), as well as copolymers containing lactic acid or lactide as the predominant component and a small proportion of a copolymerizable comonomer, such as 3-hydroxybutyrate, caprolactone, glycolic acid, etc. For various aspects of this invention it is desirable that the PLA polymers have at least 90% entantiomeric purity, i.e. at least 90% of the lactide consists of the "L" enantiomer, or at least 90% of the lactide consists of the "D" enantiomer. For other aspects of this invention it is desirable that the PLA have at least 95% or at least 98% enantiomeric purity.

Any known polymerization method, such as polycondensation or ring-opening polymerization, may be used to polymerize lactic acid. In the polycondensation method, for example, L-lactic acid, D-lactic acid, or a mixture thereof is directly subjected to dehydro-polycondensation. In the ring-opening polymerization method, a lactide that is a cyclic dimer of lactic acid is subjected to polymerization with the aid of a polymerization-adjusting agent and catalyst. The lactide may include L-lactide (a dimer of L-lactic acid), D-lactide (a dimer of D-lactic acid), and DL-lactide (a condensate of L-lactic acid and D-lactic acid). These isomers may be mixed and polymerized, if necessary, to obtain polylactic acid having any desired composition and crystallinity. A small amount of a chain-extending agent (e.g., a diisocyanate compound, an epoxy compound or an acid anhydride) may also be employed to increase the molecular weight of the polylactic acid. Generally speaking, the weight average molecular weight of the polylactic acid is within the range of about 60,000 to about 1,000,000. Polylactic acid polymer that may be used in the present invention is commercially available from Biomer, Inc. (Germany) under the name Biomer™ L9000, and from NatureWorks® LLC of Minneapolis, Minn., USA.

Polylactic acid polymer is available in staple fiber form under the NatureWorks® LLC brand name Ingeo™. Fiber Innovation Technology (Johnson City, Tenn., USA) and Far Eastern Textiles (Taipei City, Taiwan) supply polylactic acid staple fiber.

The fibers may be of a single type or may consist of blends.

The fibers may include natural and/or synthetic polymers. Examples of natural fibers include cotton, hemp, kenaf, pineapple, and linen. Synthetic fibers based on cellulose, including viscose rayon may suitably be used in various aspects of the present invention. One useful cellulose-based fiber type is Tencel® cellulosic fiber, available from Lenzing Fibers (Lenzing, Austria). Additionally cellulose derivatives, such as cellulose acetate and cellulose triacetate may be advantageously used in some embodiments of the present invention.

Each individual fiber may be monocomponent or multicomponent. Multicomponent fibers may have distinct regions of one component or another, such as side-by-side, islands-in-the-sea or sheath-core construction. Alternatively multi-component fibers may be homogeneous mixtures.

Additionally, there may be benefit in blending non-polymeric fibers, such as metallic fibers or mineral fibers to provide finished fabrics with electrical conductivity, shield electrical components, or to function as an antenna or impart fire retardancy.

In some embodiments of the invention, non-fibrous materials may be advantageously admixed or distributed among the fibers. For example, abrasives such as sand, superabsorbent polymers such as crosslinked polyacrylate or carboxymethyl cellulose particles, or adhesives may provide benefits to the end-product. In some embodiments of the invention it may be advantageous to add encapsulated fragrances, encapsulated medicaments, or encapsulated lotions.

Deposit Fibers on Screen

Figure 2:
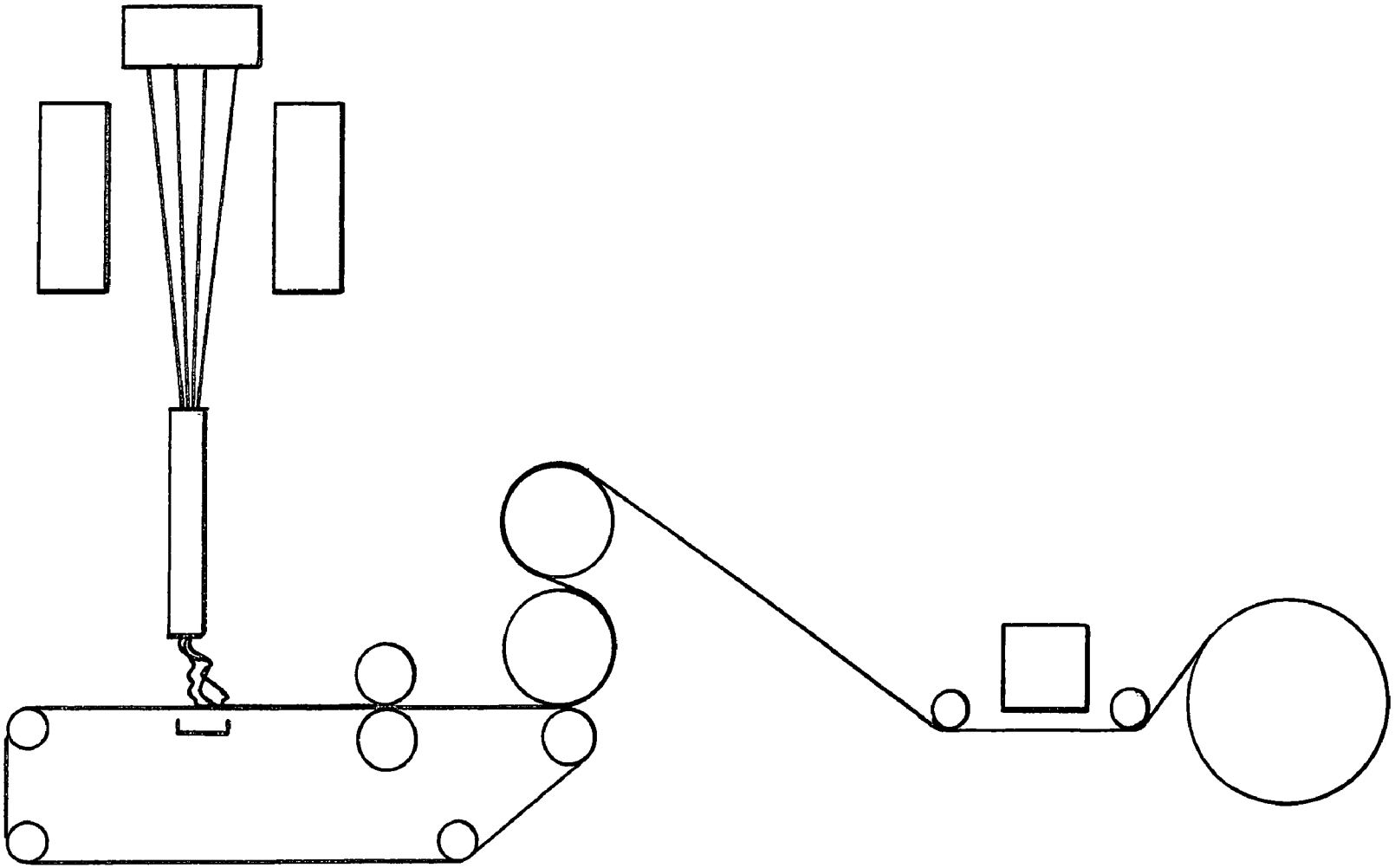
FIG. 2 is a schematic view of a continuous hydroentanglement process of an embodiment of the invention depicting an unconsolidated layer of fibers or lightly bonded nonwoven being carried on a wire screen, and then under a set of three hydroentangling jets. The water in the hydroentangling jets is at a temperature close to the glass transition temperature of the fibers. After being hydroentangled, the fibers, now a coherent fabric, pass under a cold water shower.

FIG. 2 schematically depicts a hydroentangling apparatus. The layer of fibers 11 is deposited on a foraminous support 12. The foraminous support is commonly a continuous wire screen, sometimes called a forming fabric. Forming fabrics are commonly used in the nonwovens industry and particular types are recognized by those skilled in the art as being advantageous for hydroentangling purposes. Alternatively, the foraminous support may be the surface of a cylinder, and generally may be any surface that supports the fibers and transports them under the water jets or water curtain that impart the energy to entangle the fibers. Innovent Inc. of Peabody, Mass., USA, and the afore mentioned Rieter Perfojetand, and Fleissner sell screens and cylinders suitable for this purpose.

Typically the foraminous support has holes to allow water drainage, but alternatively or additionally the foraminous support may have elevations or grooves, to allow drainage and impart topographic features on the finished fabric. In this context "water" indicates a fluid that is predominantly water, but may contain intentional or unintentional additives, including minerals, surfactants, defoamers, and various processing aides.

When the fibers are deposited on the support they may be completely unbonded, alternatively the fibers may be lightly bonded in the form of a nonwoven when they are deposited on the foraminous support. In other aspects of this invention, unbonded fibers may be deposited on the support and prior to hydroentangling the fibers may be lightly bonded using heat or other means. It is generally desirable that the fibers passing under the water jets have sufficient motility to efficiently hydroentangle.

Hydroentangle

The general conditions of hydroentangling, i.e. water pressure, nozzle-type, design of the foraminous support, are well known to those skilled in the art. References cited herein and information elsewhere available provide detailed guidance on the status quo ante of hydroentangling art. "Hydroentangle" and its derivatives refer to a process for forming a fabric by mechanically wrapping and knotting fibers into a web through the use of a high-velocity jets or curtains of water. The resulting hydroentangled fabric is sometimes called "spunlaced" or "hydroknit" in the literature. Hydroentanging is also known as "spunlacing" or "hydroknitting".

A high pressure water system delivers water to nozzles or orifices 13 from which high velocity water is expelled. The layer of fibers is transported on the foraminous support member through at least one high velocity water jet or curtain. Alternatively, more than one water jet or curtain may be used. The direct impact of the water on the fibers causes the fibers to wind and twist and entangle around nearby fibers. Additionally, some of the water may rebound off the foraminous support member, this rebounding water also contributes to entanglement.

Fibers that are less stiff as they are exposed to the water jets more easily entangle than those that are stiffer. Thus, the less stiff fibers require less energy to achieve the same degree of entanglement as their stiffer counterparts. Mechanical energy input is a function of duration of exposure to the water jets and the pressure or velocity and volumetric flow rate of the water jets.

The water used for hydroentangling is then drained into a manifold 14, typically from beneath the support member, and generally recirculated.

As a result of the hydroentangling process, the fibers are converted into a coherent fabric 21. A "coherent" fabric is a fabric that has sufficient strength that it can be easily handled. A fabric is considered to be coherent if its breaking length is greater than one meter in both the MD and CD. "Breaking length" is a measure of the breaking strength of a fabric, specifically the calculated length of a specimen whose weight is equal to its breaking load. Numerically breaking length is:

$$\frac{F}{\text{basis weight} \times W \times G}$$

Where F is the force required to break a sample of width W; and G is gravitational acceleration.

Temperature of Hydroentanglement

The stiffness of a fiber is a function of several factors including the shape and cross sectional area of the fiber; and the modulus of the fibrous material. The modulus of the fibrous material, typically a polymer or blend of polymers depends on the chemical composition of the polymer, its degree of crystallinity, and other factors. The modulus of the polymer is also strongly dependant on temperature. For many polymers and fibers, notably including cellulose, their stiffness is also a function of the moisture level of the material In a blend of fiber types wherein each fiber type has a characteristic composition, shape and size, each fiber type may have a distinctive stiffness. For example, consider a blend of polypropylene fibers and PLA fibers, each of the fibers having approximately the same size and shape. At room temperature (about 20 to 25° C.) the polyproplyene fibers are well above their glass transition temperature (Tg) and the PLA fibers are well below their Tg, so the PLA fibers are substantially stiffer than the polypropylene fibers under those conditions. "Glass transition temperature" or Tg refers to the temperature at which a material's characteristics change from that of a glass to that of a rubbery or plastic-like material. Tg is more precisely defined below. For efficient hydroentangling it may be desirable at least 25%, or at least 50%, or at least 75% of the fibers be flexible enough to easily twist and entangle, but it is generally not necessary that all the fibers be so flexible.

The modulus of a material as a function of temperature may be measured using dynamic mechanical thermal analysis (DMTA). In DMTA a sample is mechanically manipulated in a tensile, flexural, torsional or compressive mode. Strain is applied to the sample at a known or variable frequency, the temperature is varied in a controlled manner, and the resultant stress is measured. DMTA measures storage and loss modulus. As a glassy polymer is warmed from Tg−20° C. to Tg+20° C., the storage modulus decreases from approximately 1010 dyn/cm$^2$ to approximately 107 dyn/cm$^2$.

Storage modulus is proportional to the energy stored during deformation and related to the solid-like or elastic portion of the elastomer; the symbol E' is used for stretching deformations; G' is used for shearing, twisting or torsional deformations. A material with lower storage modulus is said to be more "compliant."

Loss modulus is proportional to the energy lost (usually lost as heat) during deformation and related to the liquid-like or viscous portion of the elastomer; the symbol E" is used for stretching deformations; G" is used for shearing, twisting or torsional deformations.

The ratio E"/E' is designated tan(δ), i.e. tangent(delta), and is a measure of the internal friction of the material, i.e. its ability to dissipate energy. An increase in tan(δ) represents an increase in both the viscoelastic heating (increase in E") and the compliance (decrease in E') of the material.

ASTM E 1640-04, Standard Test Method for Assignment of the Glass Transition Temperature By Dynamic Mechanical Analysis, provides guidelines for DMTA. The ASTM method suggests several measures of Tg. The temperature at which tan(δ) reaches a maximum, designated as Tt in the ASTM procedure, is one of the suggested measures of the glass transition temperature and is used in this disclosure as the measure of Tg.

Samples of a PLA spunbond nonwoven fabric were tested on a Rheometrics DMTA V instrument. The instrument is currently available from TA Instruments, a company headquartered in New Castle, Del. (USA). The testing was performed in tension/tension regime. The samples sizes were approximately length=15 mm; width=7 mm. The run was executed step by step with 2° C. increment and a frequency 2 Hz. Testing was conducted in an atmosphere of air. The DMTA data for the PLA fabric (FIG. 1) show that PLA undergoes a glass transition at approximately 69° C. with a tan(δ) peak half-width of approximately 17° C. Note that this figure is exemplary; other PLA samples are likely to exhibit higher or lower glass transition temperatures.

The Tg of polymers in general and of PLA in particular relates in a complex manner to the chemical composition of the polymer, its optical purity, processing conditions and its thermal history.

Because fibers that are at or near their Tg have lower modulus than cooler fibers, they are relatively soft and pliable, and may be hydroentangled using less energy than cooler fibers. In some aspects of this invention it is desirable that during hydroentangling at least 25%, or at least 50%, or at least 75% of the fibers be heated to a minimum temperature of Tg−15° C., or a minimum temperature of Tg−10° C., or a minimum temperature of Tg−5° C. In any case, it is desirable that the hydroentangling be conducted at a sufficiently high temperature to soften many of the fibers. In some aspects of the invention it is desirable that the hydroentangling be conducted, not above 99° C., or not above 90° C., or not above 80° C., or below the melting point of most of the fibers, or not above the Tg+10° C., or not above the Tg of a majority of the fibers.

It is recognized that a fabric or group of fibers may contain individual fibers with various glass transition temperatures. For the purpose of this disclosure, if there are fibers with glass transition temperatures in the range of 50° C. to 100° C. the average glass transition temperature of those fibers will be determined by measuring the glass transition temperature of a representative sampling of fibers using the DMTA method described above. The average glass transition temperature of the fibers with glass transition temperatures in the range of 50° C. to 100° C., designated T(50-100)g, is calculated in the following manner:

i) measure the Tg of a representative sample of fibers;

ii) considering only the fibers with Tg between 50° C. and 100° C.;

iii) $$T(50\text{-}100)g = \sum_{i=1}^{i=n} Tg(i)/n$$

wherein Tg(i) is the glass transition temperature of fiber "i" and n is the number of fibers tested that have a glass transition temperature in the range of 50° C. to 100° C.

Similarly, the tendency of fibers to soften at elevated temperatures (50° C. to 100° C.) is a measure of their suitability for various aspects of the present invention. The ratio of the storage modulus of a group of fibers at room temperature to the storage modulus of the fibers at elevated temperature (the "softening ratio") is a convenient method of measuring the extent to which the fibers soften when warmed.

It is recognized that a fabric or group of fibers may contain individual fibers with various softening ratios. For the purpose of this disclosure, if there are fibers with glass transition temperatures in the range of 50° C. to 100° C., the average softening ratio is determined by measuring the storage modulus of a representative sampling of fibers with Tg in the 50° C. to 100° C. range, first at 25° C. and then at a selected elevated temperature chosen in the range from 50° C. to 100° C.

Using the DMTA method described above, the softening ratio of a fabric or group of fibers, designated SR(t/25), is calculated in the following manner:

i) starting with fibers or a fabric, select a representative sample of fibers with Tg between 50° C. and 100° C. (it may be necessary to select individual fibers while examining them microscopically, alternatively floatation or other means may be appropriate to segregate fiber types);

ii) measure the storage modulus of the fibers with Tg between 50° C. and 100° C., E', at 25° C., this is designated E'(25);

iii) measure the storage modulus of the fibers, E' at a selected elevated temperature (in the range of 50° C.-100° C., this is designated E'(t);

iv) calculate the ratio E'(25)÷E'(t) for each fiber;

v) SR(t/25) is the mean of the quotients E'(25)÷E'(t); where t=the elevated temperature at which the storage modulus was measured.

In some aspects of the present invention it is desirable that SR(t/25) be in the range 2 to 1000. In other aspects of the present invention it is desirable that SR(t/25) be in the range 10 to 300. Alternatively SR(t/25) may be in the range 25 to 100.

When the elevated temperature selected for measuring E' is 50° C., then SR(t/25) is designated SR(50/25); when the elevated temperature selected for measuring E' is 75° C., then SR(t/25) is designated SR(75/25); when the elevated temperature selected for measuring E' is 100° C., then SR(t/25) is designated SR(100/25); and so forth.

Heating fibers to facilitate hydroentangling has an energy cost. If water is used as the heating medium, the energy required to the heat water and maintain it at an elevated temperature as it circulates and evaporates increases at elevated temperatures. Similarly, either heating the fibers with hot air or on a heated forming screen has associated energy costs. Also, because hot air and a heated screen are less efficient modes of heating the fibers, either higher temperatures must be maintained or a longer dwell time is required to heat the fibers to the desired temperature.

EXAMPLES 1 AND 2

Samples of hydroentangled nonwoven fabrics were produced on an experimental production line using PLA fiber, type 821 merge 8212D from Fiber Innovation Technology. The fibers were 3 decitex by 51 mm long monocomponent fibers. A Micro Porous screen served as the foraminous support member.

PLA fibers were carded and deposited onto the screen 11, which was moving at 30 feet/minute (9.1 m/min). The fibers were passed under water jets coming from nozzles 13 operating at 800 psi (5500 kPa) and partially hydroentangled into fabrics; the fabrics were then passed under the water jets a second time, increasing the hydroentanglement. The resulting fabrics had a basis weight of 49.6 g/m$^2$. "Basis weight" refers to the mass of a fabric per unit area, commonly expressed in g/m$^2$.

Control fabrics (example 1) were bonded by hydroentangling using cold water, approximately 10° C. Test fabrics (example 2) were bonded by hydroentangling using water at 60° C. Table 1 presents the tensile strength data of the resulting fabrics. Peak tensile stress, i.e. force, is reported in Newtons on a 108 mm wide test strip. Energy to peak stress is presented in Joules. 16 samples were tested in the machine direction (MD), i.e. in the direction in which the fabric was manufactured, and 5 samples were tested in the cross machine direction (CD), i.e. perpendicular to the direction in which the fabric was manufactured.

When drawing PLA, it is desirable to maintain the temperature between the glass transition temperature and the melting point; in that way the PLA fibers can be more easily drawn and crystallized than fibers that are quickly cooled to below the glass transition temperature. More easily drawn fibers provide process advantages: improved pack stability and fewer spinning breaks.

Additionally, drawing the fibers in the temperature range between glass transition temperature and the melting point results in less shrinkage in the finished fabric compared to when fibers are not drawn below the glass transition temperature. The fibers were deposited onto the foraminous support (also known as a web former or wire forming surface) then passed under the high velocity water jet-head in one process. Speeds that were demonstrated on this line were 0.5-1 m/sec.

In examples 3, 4, and 5 spunbond nonwoven fabrics were passed under the hydroentangling jet-head, 1, 2 and 3 times at hydrostatic pressures of 600-1200 bar. Multiple passes under the jet-head were made possible by using a cut piece of forming wire upon which the spunbond fabric was deposited onto and then passed under the water jet-head in-line. The piece was then removed with the spunbond fabrics still attached and passed through the jet-head for another time. It was noted that stable spunbond fabrics were capable of being released from the forming surface at pressures of 800-1100 bar with one pass through the jet-head. Lower pressures of 600-800 bar were used effectively with 2 and three passes under the jet-head. Spunbond fabrics were able to be easily removed from the wire with a coherently formed web.

TABLE 1

| | MD Tensile peak load (N) | | MD elongation at peak | MD Energy to peak load (J) | | CD Tensile peak load (N) | | % CD elongation at peak |
|---|---|---|---|---|---|---|---|---|
| Web description | mean | std. dev. | load mean | mean | std. dev. | mean | std. dev. | load mean |
| ex. 1. cold water | 37.3 | 8.8 | 97% | 14.8 | 3.85 | 8.6 | 2.1 | 236% |
| ex. 2. hot water | 59.2 | 10.0 | 86% | 22.0 | 4.42 | 13.5 | 2.0 | 202% |
| ratio hot:cold | 1.59 | 1.13 | 0.89 | 1.49 | 1.15 | 1.56 | 0.96 | 0.86 |

Note that the fabrics hydroentangled with hot water were about 50% stronger than the control (cold water hydroentangled) fabrics; and the elongations at break for the hot water treated samples were about 10% lower than for the controls.

PLA spunbond was produced by extruding molten PLA resin through a spin pack. The fibers exiting the spinning pack were initially cooled. The fibers are attenuated to 10-15 micrometers in diameter using a fiber drawing system. Fiber velocities estimated at 25 m/sec have been shown to produce fibers of approximately 12 micrometers diameter that have small amounts of shrinkage compared to fibers of larger denier and slower drawing velocities. Methods to produce PLA spunbond are provided in Ser. No. 11/141,748, filed 1 Jun. 2005, "Fibers and Nonwovens with Improved Properties", and Ser. No. 11/142,791, filed 1 Jun. 2005, "Method of Making Fibers and Nonwovens with Improved Properties", both of which are hereby incorporated by reference in their entireties.

It was noted that upon drying of the spunbond fabric, the wire side had some 'loose' fiber loops making a 'wooly' side to the fabric. Spunbond fabrics were subsequently made with uniform treatment to each side of the fabric. This process could be done commercially through using an 'S' wrap for the nonwoven fabric path. In the case of these trials the spunbond fabric was removed from the wire after it had been treated to the jet-heads for 1-3 passes, then the spunbond fabrics were removed and flipped so that the wire side was now facing up toward the jets. The spunbond fabrics were then passed under the jets for an additional 1-3 passes. Soft uniform spunbond fabrics were formed when passed under the hydroentangling heads at pressures of 600-800 bar for three passes on each side.

Chill Fabric

The very same characteristic (reduced modulus) that allows the warm fibers to hydroentangle using less energy than cool fibers also allows a warm fabric to be drawn and distorted, i.e. necked, more easily on the nonwovens manufacturing line. As discussed above, necking is a problem and may necessitate expensive mechanical solutions in a production environment. Alternatively, by cooling the fabric emerging from the hydroentangling process, the fibers can be "frozen" into position, and the extensional stiffness of the fabric increased. The cooled fabric thus resists necking and may be processed at high speeds without distortion.

It is desirable that the fabric, after being hydroentangled, be promptly cooled, before it is significantly subjected to distorting tension. Some experiments were conducted using on a lab-scale apparatus, at 9.1 m/min. State of the art hydroentangling equipment, such as the Jetlace 3000 system, manufactured by Rieter Perfojet, are known to operate at 350 m/minute. Other hydroentangling systems may operate in the range of 50 m/min to 1000 m/min, or in the range of 100 m/min to 500 m/min. It is desirable that the fabric be sufficiently cooled to resist necking and distortion within about 2 meter, or within about 1 meter, or within about 0.5 meter of being hydroentangled. If the fabric is not adequately cooled, beyond those distances the fabric is likely to be necked and distorted. Depending on the production speed of the fabric, and the configuration of the manufacturing line, it is desirable that the fabric be sufficiently cooled to resist necking and distortion within about 1 second, or within about 0.5 second, or within about 0.1 second of being hydroentangled.

The hydroentangled fabric may be cooled using air, a cool water bath, a cool water shower, or by direct contact with a chilled roll, belt, screen, or other means. In this context, a water "shower" indicates a relatively low pressure or velocity water stream that generally does not cause the fibers in the fabric to further entangle. The water shower or other cooling means is generally positioned so that the fabric is cooled shortly after being hydroentangled. In some aspects of the invention the fabric should be cooled to a temperature less than 20° C. below the T(50-100)g. In some aspects of the invention the fabric should be cooled to a temperature less than 30° C. below the T(50-100)g. If water is used as the cooling agent it may contain intentional or unintentional additives, including minerals, surfactants, defoamers, and various processing aides.

Referring again to FIG. 2, the hydroentangled fabric 31 is carried on a foraminous support 22, then it passes through a cold or cool water shower 23. The water used for cooling the fabric is then drained 24. Excess water may be removed by blowing air through the fabric, squeezing the fabric between felts, or subjecting the fabric to high centrifugal force by, for example causing the fabric to make a sharp turn over a small diameter roller. Generally, the removed water is recirculated.

It may be desirable to configure the manufacturing line to avoid excessive tension on the fabric. In this context "excessive" tension is tension that would neck or distort the fabric. Before the fabric is fully cooled it may be desirable to carry the fabric on a moving belt or a cylinder to minimize the tension on the fabric.

Table 2 below shows that a warm hydroentangled fabric is more easily distorted at a temperature close to or above the glass transition temperature of the fibers making up the fabric.

A hydroentangled nonwoven fabric (example 3) was produced on an experimental production line using (i) 70% monocomponent PLA fiber from Fiber Innovation Technology (1.3 decitex by 38 mm long) and (ii) 30% Tencel® cellulosic fiber, available from Lenzing (1.7 decitex×38 mm long). The resulting fabric had a basis weight of 30 g/m$^2$. The force, i.e. load on the test cell, required to stretch the fabric by 10% in the machine direction was measured at various temperatures. A 102 mm wide fabric sample was placed between the jaws of a Syntech tensile tester with a 102 mm gap (or "gauge"). The fabric was stretched at a rate of 5.1 mm/sec. to 112 mm in length, i.e. 10%, and the force on the fabric was recorded. This testing was conducted in triplicate at various temperatures, as shown in Table 2.

TABLE 2

Force Required to Stretch Fabric at Various Temperatures

| Temperature at which tensile testing was conducted | Load @ 10% elongation in the machine direction (N) | | |
|---|---|---|---|
| 22° C. | 21.4 | 24.8 | 23.0 |
| 45° C. | 21.2 | 20.1 | 21.5 |
| 50° C. | 16.9 | 19.0 | 17.2 |
| 55° C. | 18.8 | 18.7 | 17.3 |
| 60° C. | 16.6 | 18.6 | 19.0 |
| 65° C. | 18.8 | 19.4 | 18.3 |
| 70° C. | 16.3 | 17.3 | 15.3 |
| 75° C. | 14.7 | 15.3 | 13.8 |
| 80° C. | 13.1 | 14.8 | 14.0 |

These data demonstrate that a hydroentangled fabric containing 30% cellulosic fibers and 70% PLA fibers was substantially more compliant at close to or above the glass transition temperature of the PLA (about 60° C.) than at room temperature. In a high speed manufacturing environment, a more compliant fabric is more susceptible to distortion, so rapidly cooling the fabric to significantly below the glass transition temperature of the fibers that have a glass transition temperature in the range of 50° C. to 100° C. limits the distortion of the fabrics.

In the example provided in Table 2, it is noteworthy that 30%, of the fibers in the fabric were Tencel® cellulosic fiber. The glass transition temperature of cellulose is strongly dependent upon its moisture content. Fully hydrated cellulose has a Tg of about 0° C. or less, but cellulose with less moisture has a higher Tg.

When dried to a moisture content below about 4%, cellulose has a Tg above about 100° C. In certain embodiments of this invention, cellulose fibers will be fully saturated with water when hydroentangled and subsequently when cooled; in those embodiments the Tg of water-saturated cellulose will nominally be considered to be 0° C.

Further Processing

The cooled fabric may then be further treated, for example dried, laminated with other fabrics or films, saturated, cut into individual sheets, slit, or rolled.

Hydroentangled fabrics, such as those described above, may be used in an absorbent article, such as, but not limited to, personal care absorbent articles, such as diapers, training pants, absorbent underpants, incontinence articles, feminine hygiene products (e.g., sanitary napkins or catamenial tampons), swim wear, baby wipes, and so forth; medical absorbent articles, such as garments, fenestration materials, underpads, bedpads, bandages, absorbent drapes, and medical wipes; food service wipers; clothing articles; and so forth. Materials and processes suitable for forming such absorbent articles are well known to those skilled in the art. Typically, absorbent articles include a substantially liquid-impermeable layer (e.g., outer cover), a liquid-permeable layer (e.g., bodyside liner, surge layer, etc.), and an absorbent core. The absorbent web of the present invention may be employed as any one or more of the liquid transmissive (non-retentive) and absorbent layers, and is desirably used to form the absorbent core. For example, the absorbent web may form the entire absorbent core. Alternatively, the absorbent web may form only a portion of the core, such as a layer of an absorbent composite that includes one or more additional layers (e.g., wet-formed paper webs, coform webs, etc.).

Various embodiments of an absorbent article that may be formed according to the present include diapers, incontinence articles, sanitary napkins, diaper pants, feminine napkins, children's training pants, and so forth. Diapers may be hourglass shape in an unfastened configuration. However, other shapes may of course be utilized, such as a generally rectangular shape, T-shape, or I-shape. Typically a diaper includes a chassis formed by various components, including an outer cover, bodyside liner, an absorbent core, and a surge layer. Other layers may also be included, or be eliminated in certain embodiments of absorbent articles.

The outer cover is typically formed from a material that is substantially impermeable to liquids. For example, the outer cover may be formed from a thin plastic film or other flexible liquid-impermeable material. In one embodiment, the outer cover is formed from a polyethylene film having a thickness of from about 0.01 millimeter to about 0.05 millimeter. If a more cloth-like feeling is desired, the outer cover may be formed from a polyolefin film laminated to a nonwoven web, such as hydroentangled fabrics of the present invention. In another example, a stretch-thinned polypropylene film having a thickness of about 0.015 millimeter may be thermally laminated to a spunbond web of polypropylene fibers. The polypropylene fibers may have a denier per filament of about 1.5 to 2.5, and the nonwoven web may have a basis weight of about 10 to 20 grams per square meter. The outer cover may also include bicomponent fibers, such as polyethylene/polypropylene bicomponent fibers. In addition, the outer cover may also contain a material that is impermeable to liquids, but permeable to gases and water vapor (i.e., "breathable"). This permits vapors to escape from the absorbent core, but still prevents liquid exudates from passing through the outer cover.

The diaper also includes a bodyside liner, which may be the hydroentangled fabric of the present invention. The bodyside liner is generally employed to help isolate the wearer's skin from liquids held in the absorbent core. The liner typically presents a bodyfacing surface that is compliant, soft feeling, and non-irritating to the wearer's skin. In many absorbent articles the liner is less hydrophilic than the absorbent core so that its surface remains relatively dry to the wearer. The liner is generally liquid-permeable to permit liquid to readily penetrate through its thickness. The bodyside liner may be formed from a wide variety of materials, such as porous foams, reticulated foams, apertured plastic films, natural fibers (e.g., wood or cotton fibers), synthetic fibers (e.g., polyester or polypropylene fibers), or a combination thereof. In some embodiments, woven and/or nonwoven fabrics are used for the liner. For example, the bodyside liner may be formed from a meltblown or spunbonded web of polyolefin fibers. The liner may also be a bonded-carded web of natural and/or synthetic fibers. The liner may further be composed of a substantially hydrophobic material that is optionally treated with a surfactant or otherwise processed to impart a desired level of wettability and hydrophilicity. The surfactant may be applied by any conventional method, such as spraying, printing, brush coating, foaming, and so forth. When utilized, the surfactant may be applied to the entire liner or may be selectively applied to particular sections of the liner, such as to the medial section along the longitudinal centerline of the diaper. The liner may further include a composition that is configured to transfer to the wearer's skin for improving skin health. Suitable compositions for use on the liner are described in U.S. Pat. No. 6,149,934 to Krzysik et al., which is incorporated herein in its entirety by reference thereto for all purposes.

The diaper may also include a surge layer that helps to decelerate and diffuse surges or gushes of liquid that may be rapidly introduced into the absorbent core. Desirably, the surge layer rapidly accepts and temporarily holds the liquid prior to releasing it into the storage or retention portions of the absorbent core. In the illustrated embodiment, for example, the surge layer is interposed between an inwardly facing surface of the bodyside liner and the absorbent core. Alternatively, the surge layer may be located on an outwardly facing surface of the bodyside liner. The surge layer is typically constructed from highly liquid-permeable materials. Suitable materials may include porous woven materials, porous nonwoven materials, and apertured films. Some examples include, without limitation, flexible porous sheets of polyolefin fibers, such as polypropylene, polyethylene or polyester fibers; webs of spunbonded polypropylene, polyethylene or polyester fibers; webs of rayon fibers; bonded carded webs of synthetic or natural fibers or combinations thereof. Other examples of suitable surge layers are described in U.S. Pat. Nos. 5,486,166 and 5,490,846 to Ellis, et al., which are incorporated herein in their entirety by reference thereto for all purposes.

Besides the above-mentioned components, the diaper may also contain various other components as is known in the art. For example, the diaper may also contain a substantially hydrophilic tissue wrapsheet, which may the hydroentangled fabric of the present invention that helps maintain the integrity of the fibrous structure of the absorbent core. The tissue wrapsheet is typically placed about the absorbent core over at least the two major facing surfaces thereof, and composed of an absorbent cellulosic material, such as creped wadding or a high wet-strength tissue. The tissue wrapsheet may be configured to provide a wicking layer that helps to rapidly distribute liquid over the mass of absorbent fibers of the absorbent core. The wrapsheet material on one side of the absorbent fibrous mass may be bonded to the wrapsheet located on the opposite side of the fibrous mass to effectively entrap the absorbent core.

Furthermore, the diaper may also include a ventilation layer (not shown) that is positioned between the absorbent core and the outer cover. When utilized, the ventilation layer may help insulate the outer cover from the absorbent core, thereby reducing dampness in the outer cover. Examples of such ventilation layers may include breathable laminates (e.g., nonwoven web laminated to a breathable film), such as described in U.S. Pat. No. 6,663,611 to Blaney, et al., which is incorporated herein in its entirety by reference thereto for all purpose.

In some embodiments, the diaper may also include extensions located at or near the waist band, referred to as "ears," that extend from the side edges of the diaper into one of the waist regions. The ears may be integrally formed with a selected diaper component. For example, the ears may be integrally formed with the outer cover or from the material employed to provide the top surface. In alternative configurations, the ears may be provided by members connected and assembled to the outer cover, the top surface, between the outer cover and top surface, or in various other configurations.

The diaper may also include a pair of containment flaps that are configured to provide a barrier and to contain the lateral flow of body exudates. The containment flaps may be located along the laterally opposed side edges of the bodyside liner adjacent the side edges of the absorbent core. The containment flaps may extend longitudinally along the entire length of the absorbent core, or may only extend partially along the length of the absorbent core. When the containment flaps are shorter in length than the absorbent core, they may be selectively positioned anywhere along the side edges of diaper in a crotch region. In one embodiment, the containment flaps extend along the entire length of the absorbent core to better contain the body exudates. Such containment flaps are generally well known to those skilled in the art. For example, suitable constructions and arrangements for the containment flaps are described in U.S. Pat. No. 4,704,116 to Enloe, which is incorporated herein in its entirety by reference thereto for all purposes.

The diaper may include various elastic or stretchable materials, such as a pair of leg elastic members affixed to the side edges to further prevent leakage of body exudates and to support the absorbent core. In addition, a pair of waist elastic members may be affixed to longitudinally opposed waist edges of the diaper. The leg elastic members and the waist elastic members are generally adapted to closely fit about the legs and waist of the wearer in use to maintain a positive, contacting relationship with the wearer and to effectively reduce or eliminate the leakage of body exudates from the diaper. As used herein, the terms "elastic" and "stretchable" include any material that may be stretched and return to its original shape when relaxed. Suitable polymers for forming such materials include, but are not limited to, block copolymers of polystyrene, polyisoprene and polybutadiene; copolymers of ethylene, natural rubbers and urethanes; etc. Particularly suitable are styrene-butadiene block copolymers sold by Kraton Polymers of Houston, Tex. under the trade name Kraton®. Other suitable polymers include copolymers of ethylene, including without limitation ethylene vinyl acetate, ethylene methyl acrylate, ethylene ethyl acrylate, ethylene acrylic acid, stretchable ethylene-propylene copolymers, and combinations thereof. Also suitable are coextruded composites of the foregoing, and elastomeric staple integrated composites where staple fibers of polypropylene, polyester, cotton and other materials are integrated into an elastomeric meltblown web. Certain elastomeric single-site or metallocene-catalyzed olefin polymers and copolymers are also suitable for the side panels.

The diaper may also include one or more fasteners. For example, two flexible fasteners may be positioned on opposite side edges of waist regions to create a waist opening and a pair of leg openings about the wearer. The shape of the fasteners may generally vary, but may include, for instance, generally rectangular shapes, square shapes, circular shapes, triangular shapes, oval shapes, linear shapes, and so forth. The fasteners may include, for instance, a hook material. In one particular embodiment, each fastener includes a separate piece of hook material affixed to the inside surface of a flexible backing.

The various regions and/or components of the diaper may be assembled together using any known attachment mechanism, such as adhesive, ultrasonic, thermal bonds, etc. Suitable adhesives may include, for instance, hot melt adhesives, pressure-sensitive adhesives, and so forth. When utilized, the adhesive may be applied as a uniform layer, a patterned layer, a sprayed pattern, or any of separate lines, swirls or dots. As one example, the outer cover and bodyside liner are assembled to each other and to the absorbent core using an adhesive. Alternatively, the absorbent core may be connected to the outer cover using conventional fasteners, such as buttons, hook and loop type fasteners, adhesive tape fasteners, and so forth. Similarly, other diaper components, such as the leg elastic members, waist elastic members and fasteners, may also be assembled into the diaper using any attachment mechanism.

Also, fabrics of this invention may find utility as filters for air, water, or oil.

Furthermore these fabrics may be useful as part of a growth medium for certain microorganisms, or as a support for plants. The fabrics of this invention may have use in durable applications, such as clothing, furnishings, and as matrices in epoxy and fiberglass laminates.

Post-treatments for the fabrics of certain embodiments of this invention may include treatment with anti-microbials, printing, dyeing, and hydrophobic or hydrophilic treatments.

The examples and descriptions provided above are intended to describe various embodiments of the invention and should not be construed as limiting; the invention is defined by the claims below.

Having described this invention, and of the manner and process of making it, in such full, clear, concise, and exact terms as to enable any person skilled in the art to which it pertains, to make and use the same, and having set forth the best mode of the invention contemplated by us;

We claim:

1. A process for preparing a nonwoven fabric comprising the steps of:

(a) depositing fibers on a foraminous support;

(b) impinging water upon the fibers;

(c) entangling the fibers to form a coherent fabric; and (d) cooling the fabric within 1 second after being entangled; wherein, at least 25% of the fibers have a glass transition temperature ($T_g$) in the range 50° C. to 100° C. and an average $T_g$ of $T(50\text{-}100)_g$; and wherein the water has a temperature in the range from 15° C. below $T(50\text{-}100)_g$ to 99° C.

2. The process of claim 1 wherein at least 50% of the fibers have a $T_g$ in the range 50° C. to 99° C.

3. The process of claim 1 wherein at least 75% of the fibers have a $T_g$ in the range of 50° C. to 99° C.

4. The process of claim 1 wherein the fabric is cooled to 20° C. below $T(50\text{-}100)_g$ within 0.5 second of being hydroentangled.

5. The process of claim 1 wherein the fabric is cooled to 20° C. below $T(50\text{-}100)_g$ within 0.1 second of being hydroentangled.

6. The process of claim 1 wherein the temperature of the water is in the range from 15° C. below $T(50\text{-}100)_g$ to 99° C.

7. The process of claim 1 wherein the temperature of the water is in the range from 10° C. below $T(50\text{-}100)_g$ to 90° C.

8. The process of claim 1 wherein the temperature of the water is in the range from 5° C. below $T(50\text{-}100)_g$ to 80° C.

9. The process of claim 1 wherein at least 50% of the fibers comprise polylactic acid.

10. The process of claim 9 wherein the fabric is cooled to 20° C. below $T(50\text{-}100)_g$ within 0.5 second of being hydroentangled.

11. The process of claim 9 wherein the temperature of the water is in the range from 15° C. below $T(50\text{-}100)_g$ to 99° C.

12. The process of claim 9 wherein the temperature of the water is in the range from 5° C. below $T(50\text{-}100)_g$ to 80° C.

13. The process of claim 1 wherein the fibers are unconsolidated when they are deposited on the foraminous support.

14. The process of claim 1 wherein the fibers constitute a coherent fabric immediately before they are hydroentangled.

15. The process of claim 1 wherein the fibers are in the form of a spunbonded PLA web.

16. A process for preparing a nonwoven fabric comprising the steps of:

(a) depositing fibers on a foraminous support;

(b) impinging water upon the fibers;

(c) entangling the fibers to form a coherent fabric; and (d) cooling the fabric within 1 second of being entangled; wherein, at least 25% of the fibers have a glass transition temperature ($T_g$) in the range of 50° C. to 100° C. and the fibers with a $T_g$ in the range 50° C. to 100° C. have a softening ratio, SR(75/25), in the range of 2 to 1000.

17. The process of claim 16 wherein the temperature of the water is in the range of the average 50° C. to 99° C.

18. The process of claim 17 wherein the fibers with a $T_g$ in the range 50° C. to 100° C. have a softening ratio, SR(75/25) in the range of 10 to 300.

19. The process of claim 17 wherein the temperature of the water is in the range of the average 50° C. to 99° C.

* * * * *